US010059415B1

(12) United States Patent
Anschuetz et al.

(10) Patent No.: US 10,059,415 B1
(45) Date of Patent: Aug. 28, 2018

(54) SYSTEM AND METHOD FOR CONTROLLING A TILT-TRIM POSITION OF A MARINE PROPULSION DEVICE

(71) Applicant: Brunswick Corporation, Lake Forest, IL (US)

(72) Inventors: Steven M. Anschuetz, Fond du Lac, WI (US); Mark J. Lemke, Sun Prairie, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/679,516

(22) Filed: Aug. 17, 2017

Related U.S. Application Data

(63) Continuation-in-part of application No. 15/676,201, filed on Aug. 14, 2017.

(51) Int. Cl.
*B63H 20/10* (2006.01)

(52) U.S. Cl.
CPC ..... *B63H 20/10* (2013.01)

(58) Field of Classification Search
CPC ..... B63H 20/10
See application file for complete search history.

(56) References Cited

U.S. PATENT DOCUMENTS 3,881,443 A 5/1975 Hamp
4,310,320 A 1/1982 Pitchford
4,318,699 A 3/1982 Wenstadt et al.
4,490,120 A 12/1984 Hundertmark
4,605,375 A 8/1986 Ferguson
4,776,818 A 10/1988 Cahoon et al.
4,872,857 A 10/1989 Newman et al.
5,007,866 A 4/1991 Okita
5,063,381 A * 11/1991 Ito ..... B63B 49/00 340/461
5,113,780 A 5/1992 Bennett et al.
(Continued)

OTHER PUBLICATIONS

Andrasko et al., "Systems and Methods for Automatically Controlling Attitude of a Marine Vessel with Trim Devices", Unpublished U.S. Appl. No. 14/873,803, filed Oct. 2, 2015.
(Continued)

*Primary Examiner* — Stephen P Avila
(74) *Attorney, Agent, or Firm* — Andrus Intellectual Property Law, LLP

(57) ABSTRACT

A system for controlling a tilt-trim position of a propulsion device on a marine vessel includes a user input device generating a command to rotate the propulsion device to a desired tilt-trim position, a position sensor sensing a current tilt-trim position of the propulsion device, a control module receiving the user command and the current tilt-trim position, and a tilt-trim actuator rotating the propulsion device. In response to determining that the propulsion device's engine is not running, the control module rotates the propulsion device until the desired tilt-trim position is achieved, and starts the engine in response to determining that the current tilt-trim position does not exceed a threshold. In response to determining that the engine is running, the control module determines whether a vessel and/or engine speed condition is met, and if so, rotates the propulsion device about the tilt-trim axis until the desired tilt-trim position is achieved.

22 Claims, 6 Drawing Sheets

(56) References Cited

U.S. PATENT DOCUMENTS

| | | | | |
|---|---|---|---|---|
| 5,142,473 | A | 8/1992 | Davis | |
| 5,474,013 | A | 12/1995 | Wittmaier | |
| 6,007,391 | A | 12/1999 | Eilert | |
| 6,273,771 | B1 | 8/2001 | Buckley et al. | |
| 6,287,160 | B1 | 9/2001 | Onoue | |
| 6,923,136 | B1 | 8/2005 | D'Alessandro | |
| 7,104,854 | B2 | 9/2006 | Saito | |
| 7,128,625 | B2 | 10/2006 | Saito | |
| 7,311,058 | B1 | 12/2007 | Brooks et al. | |
| 7,347,753 | B1 | 3/2008 | Caldwell et al. | |
| 7,381,108 | B1 | 6/2008 | Salmon | |
| 7,467,596 | B2 | 12/2008 | Salmon | |
| 8,216,007 | B2 | 7/2012 | Moore | |
| 8,840,439 | B1 | 9/2014 | Wiatrowski et al. | |
| 9,156,533 | B2 | 10/2015 | Mueller | |
| 9,517,825 | B1 | 12/2016 | Anschuetz et al. | |
| 9,598,160 | B2 | 3/2017 | Andrasko et al. | |
| 9,694,892 | B1 | 7/2017 | Anschuetz et al. | |
| 9,745,036 | B2 | 8/2017 | Andrasko et al. | |
| 9,751,605 | B1 | 9/2017 | Anschuetz et al. | |
| 9,764,810 | B1 | 9/2017 | Andrasko et al. | |
| 9,862,471 | B1 | 1/2018 | Taylor et al. | |
| 9,896,174 | B1 | 2/2018 | Anschuetz | |
| 2002/0174818 | A1 | 11/2002 | von Wolske | |
| 2003/0077953 | A1* | 4/2003 | Kaji | B63H 20/10 440/1 |
| 2004/0014376 | A1 | 1/2004 | Noyes | |
| 2004/0224577 | A1 | 11/2004 | Kaji | |
| 2007/0093149 | A1 | 4/2007 | Csoke | |
| 2010/0114412 | A1* | 5/2010 | Mizutani | B63H 20/12 701/21 |
| 2011/0195816 | A1 | 8/2011 | Martin et al. | |
| 2011/0281477 | A1* | 11/2011 | Inoue | F02D 29/02 440/1 |
| 2016/0068247 | A1 | 3/2016 | Morvillo | |

OTHER PUBLICATIONS

Anschuetz et al., "System and Method for Trimming a Trimmable Marine Device With Respect to a Marine Vessel", Unpublished U.S. Appl. No. 15/003,326, filed Jan. 21, 2016.

Andrasko et al., "Methods for Positioning Multiple Trimmable Marine Propulsion Devices on a Marine Vessel", Unpublished U.S. Appl. No. 15/147,264, filed May 5, 2016.

Taylor et al., "Systems and Methods for Positioning Multiple Trimmable Marine Propulsion Devices on a Marine Vessel", Unpublished U.S. Appl. No. 15/180,620, filed Jun. 13, 2016.

Mercury Marine, 90-8M0081623 JPO Owners Manual—Auto Trim Portion, Section 2—On the Water, May 2013, p. 21.

Mercury Marine, 90-8M0076286 JPO Service Manual—Auto Trim Portion, Theory of Operation, Jul. 2013, p. 2A-5.

* cited by examiner

SYSTEM AND METHOD FOR CONTROLLING A TILT-TRIM POSITION OF A MARINE PROPULSION DEVICE

CROSS-REFERENCE TO RELATED APPLICATION

The present application is a continuation-in-part of U.S. application Ser. No. 15/676,201, filed on Aug. 14, 2017, which is hereby incorporated by reference herein.

FIELD

The present disclosure relates to systems and methods for positioning a marine propulsion device at a desired tilt-trim position with respect to a transom of a marine vessel.

BACKGROUND

U.S. Pat. No. 4,318,699 discloses a sensor that responds to the operation of a marine transportation system to sense on-plane and off-plane conditions of a boat to operate a trim control to automatically position a trimmable drive for a desired boating operation. The preferred embodiment senses engine speed while an alternative embodiment senses fluid pressure opposing boat movement. The drive is moved to an auto-out position at high speeds and to a trimmed-in position at lower speeds.

U.S. Pat. No. 4,490,120 discloses a hydraulic system for trimming and tilting an outboard propulsion unit, which includes both trim piston-cylinder units and a trim-tilt piston-cylinder unit. The flow of hydraulic fluid from the reversible pump is controlled by a spool valve. A pressure relief valve is mounted in the spool to maintain pressure on one side of the spool when the pump is turned off to rapidly close the return valve and prevent further movement of the piston-cylinder units.

U.S. Pat. No. 4,776,818 discloses an electrical control system for trimming a pair of stern motors or drives mounted side-by-side on a boat. The two drives are both jointly and independently movable through a plurality of trim positions. The system includes two trim cylinders, each coupled to one associated drive, to move its associated drive to different trim positions both jointly as well as independently of each other. An operator controlled mechanism energizes and de-energizes the two trim cylinders simultaneously to jointly vary the trim position of the two drives. Two lines, each coupled at its first end to one associated drive, independently detect both the angular trim position of its associated drive with respect to the other drive as well as detect the trim position of the two drives jointly. Automatic control means coupled to the second end of each of the two lines is responsive to the two lines, when the two drives are not in the desired equal trim position with respect to each other, and controls switches to inactivate one of the trim cylinders and thereby move the other of the trim cylinders with respect to the inactivated one trim cylinder until the desired equal trim position is achieved between the two drives.

U.S. Pat. No. 6,007,391 discloses an automatically adjustable trim system for a marine propulsion system that provides automatic trimming of the propeller in response to increased loads on the propeller. A propulsion unit is attached to a boat transom through a tilt mechanism including a transom bracket and a swivel bracket. In a first embodiment, the transom bracket is clamped to a flexible transom which flexes in response to forces exerted on the transom during acceleration. In a second embodiment, the transom bracket is clamped to a transom bracket mounting platform that is generally parallel to and pivotally attached to the transom. A trim angle biasing mechanism is mounted between the transom and the transom bracket mounting platform for automatically adjusting the trim angle. A third embodiment includes a trim angle biasing mechanism incorporated into the transom bracket or swivel bracket. A fourth embodiment includes a spring-loaded pawl assembly between the swivel bracket and transom bracket.

U.S. Pat. No. 7,347,753 discloses a hydraulic system for a sterndrive marine propulsion device that directs the flow of hydraulic fluid through the body and peripheral components of a gimbal ring in order to reduce the number and length of flexible hydraulic conduits necessary to conduct pressurized hydraulic fluid from a pump to one or more hydraulic cylinders used to control the trim or tilt of a marine drive unit relative to a gimbal housing.

Unpublished U.S. patent application Ser. No. 14/873,803, filed Oct. 2, 2015, and assigned to the Applicant of the present application, discloses systems and methods for controlling position of a trimmable drive unit with respect to a marine vessel. A controller determines a target trim position as a function of vessel or engine speed. An actual trim position is measured and compared to the target trim position. The controller sends a control signal to a trim actuator to trim the drive unit toward the target trim position if the actual trim position is not equal to the target trim position and if at least one of the following is true: a defined dwell time has elapsed since a previous control signal was sent to the trim actuator to trim the drive unit; a given number of previous control signals has not been exceeded in an attempt to achieve the target trim position; and a difference between the target trim position and the actual trim position is outside of a given deadband. The method may include sending a second control signal for a defined brake time to trim the drive unit in an opposite, second direction in response to a determination that the actual trim position has one of achieved and exceeded the target trim position.

Each of the above U.S. patents and applications is hereby incorporated herein by reference.

SUMMARY

According to one example of the present disclosure, a method for controlling a tilt-trim position of a marine propulsion device on a transom of a marine vessel is disclosed. The method includes receiving a user input to rotate the propulsion device about a horizontal tilt-trim axis to a predetermined desired tilt-trim position and determining whether an engine powering the propulsion device is running. In response to determining that the engine is not running, the method includes rotating the propulsion device about the tilt-trim axis until determining that a current tilt-trim position of the propulsion device is equal to the desired tilt-trim position, and starting the engine in response to determining that the current tilt-trim position is less than a first trim position threshold.

According to another example of the present disclosure, a system for controlling a tilt-trim position of a marine propulsion device on a transom of a marine vessel includes a user input device generating a command to rotate the propulsion device to a predetermined desired tilt-trim position, an engine speed sensor sensing a speed of an engine powering the propulsion device, and a vessel speed sensor sensing a speed of the marine vessel. A tilt-trim position sensor senses a current tilt-trim position of the propulsion device with respect to the transom. A control module receives the command from the user input device, the engine speed from the engine speed sensor, the vessel speed from the vessel speed sensor, and the tilt-trim position from the tilt-trim position sensor. A tilt-trim actuator is configured to rotate the propulsion device about a horizontal tilt-trim axis in response to signals from the control module. The control module determines whether the engine is running and then does one of the following: In response to determining that the engine is not running, the control module controls the tilt-trim actuator to rotate the propulsion device about the tilt-trim axis until determining that the current tilt-trim position is equal to the desired tilt-trim position, and starts the engine in response to determining that the current tilt-trim position is less than or equal to a first trim position threshold. In response to determining that the engine is running, the control module determines whether at least one of a vessel speed condition and an engine speed condition is met, and in response to the at least one of the vessel speed condition and the engine speed condition being met, controls the tilt-trim actuator to rotate the propulsion device about the tilt-trim axis until determining that the current tilt-trim position is equal to the desired tilt-trim position.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

The present disclosure relates to systems and methods for controlling tilt-trim positions of one or more marine propulsion devices on a marine vessel by controlling one or more tilt-trim actuators that couple the propulsion device(s) to the transom of the marine vessel. In one example, the tilt-trim actuator is a hydraulic piston-cylinder in fluid communication with a hydraulic pump-motor combination, although the principles of some of the below examples could apply equally to electric linear actuators, pneumatic actuators, or other types of trim devices. The tilt-trim actuator may be actuated between an extended position and a retracted position by provision of hydraulic fluid, electrical power, pneumatic fluid, etc. The extension and retraction of such a tilt-trim actuator can be used to rotate the propulsion device, such as but not limited to an outboard motor or the outboard portion of a sterndrive or pod drive, up and down with respect to a marine vessel to which it is coupled. Such a propulsion device can be powered by a propulsion system, including, but not limited to, an internal combustion engine, an electric motor, rotating shaft(s), a transmission, a clutch, and/or a gear train.

Those skilled in the art of marine vessel propulsion and control are familiar with many different ways in which the tilt-trim position of a propulsion device can be varied to change the handling or feel of the vessel. For example, many manual trim control systems are known to those skilled in the art. The operator inputs a command to change the trim position of the propulsion device, for example by using a keypad, button, or similar input device with "trim up" and "trim down" input choices. The operator can select these input choices to trim the propulsion device up or down until a desired handling or feel of the vessel over the water is achieved. The operator can use the same or a different input device to rotate the propulsion device up beyond the trim range and into the tilt range, for example if the operator wishes to instead use a trolling motor or kicker or is trailering the vessel.

Figure 1:
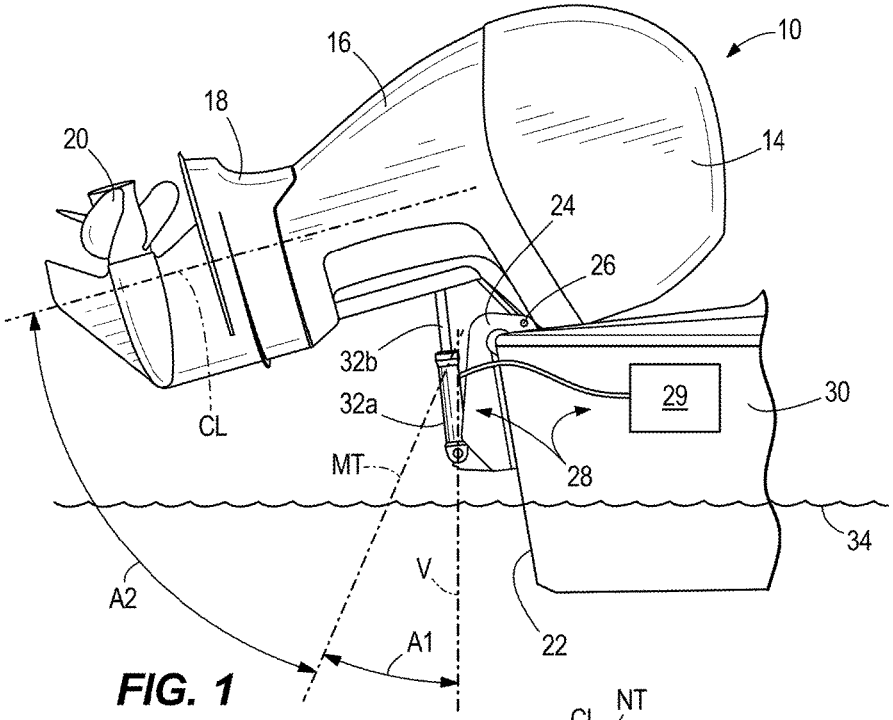
FIG. 1 illustrates one example of a propulsion device at a maximum tilt position.

FIG. 1 illustrates one example of a marine propulsion device 10, which in this example is an outboard motor. In other examples, the propulsion device 10 could be a trimmable sterndrive, trimmable pod drive, trimmable jet drive, or the like. The propulsion device 10 includes a powerhead section 14 connected via a midsection 16 to a lower unit 18, including a propeller 20 that provides propulsive force as it rotates through water 34. In other examples, the propulsion device 10 includes an impeller or a jet pump for providing propulsive force. The propulsion device 10 is coupled to a transom 22 of a marine vessel 30 by way of a mounting bracket 24. The propulsion device 10 is rotatable up and down with respect to the marine vessel 30 about a tilt/trim axis 26 by way of extension and retraction of a tilt-trim actuator 28. As mentioned above, the tilt-trim actuator 28 can be a hydraulic, pneumatic, or electric device. Here, the tilt-trim actuator 28 is a hydraulic device including a trim cylinder 32*a* and trim rod 32*b* and a pump/motor 29 that provides and removes hydraulic fluid to/from the trim cylinder 32*a* to extend and retract the trim rod 32*b* and raise and lower the propulsion device 10 connected thereto. Note that the pump/motor 29 could be provided other than where schematically shown.

Figure 2:
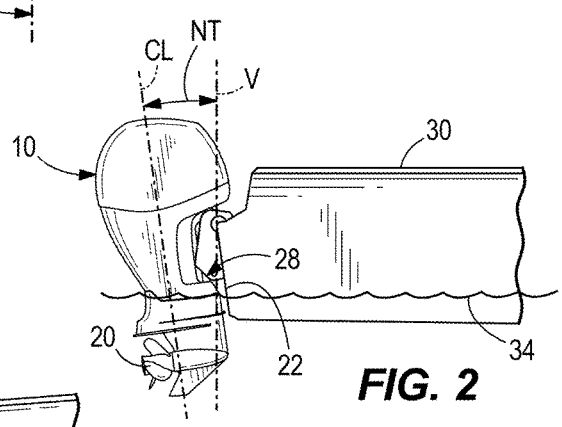
FIG. 2 illustrates the propulsion device at a minimum trim position.
Figure 3:
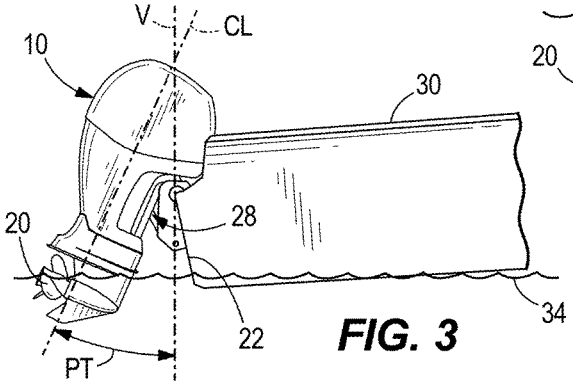
FIG. 3 illustrates the propulsion device at a maximum trim position.

FIGS. 2-3 illustrate how the attitude of the marine vessel 30 can be controlled by way of controlling a trim position of the propulsion device 10 with respect to the transom 22 of the marine vessel 30. The propulsion device 10 can be trimmed to different angles with respect to the transom 22 via the tilt-trim actuator 28 as known to those having ordinary skill in the art. In FIG. 2, the propulsion device 10 is shown in a trimmed in (trimmed down) position. This can be seen by comparing centerline CL of the propulsion device 10 with vertical line V, where the lines CL and V will intersect below where the propulsion device 10 is connected to the transom 22 at negative trim angle NT. Here, the propulsion device 10 is shown in a minimum trim position, in which the trim rod 32*b* is fully retracted into the trim cylinder 32*a* and the propulsion device 10 is therefore at 0% of its potential full angular movement. In FIG. 3, the propulsion device 10 is shown in a trimmed out (trimmed up) position in which the lines CL and V intersect above the propulsion device's connection point to the transom 22 at positive trim angle PT. Here, the propulsion device 10 is shown in a maximum trim position, in which the trim rod 32*b* is partially extended from the trim cylinder 32*a* and the propulsion device 10 is at a predetermined percentage of its potential full angular movement that will maintain the propeller 20 in the water at a functional position. Generally, the maximum trim position is between about 25% to about 35% of potential full angular movement, but varies based on the size and type of the propulsion device 10, the tilt-trim actuator 28, and the marine vessel 30, and the height of the propulsion device 10 on the transom 22. Above this predetermined maximum trim position, the propeller 20 is not covered by enough water that it can produce thrust to move the vessel and the propulsion device 10 is very loud.

The trim position in FIG. 2 is generally used when the marine vessel 30 is operating at slower speeds. For example, the trim position in FIG. 2 is often used during launch of the marine vessel 30, before the marine vessel has gotten up to speed and on plane. In contrast, the trim position shown in FIG. 3 is often used when the marine vessel 30 is on-plane and high speeds are required. At high speeds, the trim position shown in FIG. 3 causes the bow of the marine vessel 30 to rise out of the water 34 as suggested by the higher height of the marine vessel 30 in the water 34 in comparison to the position shown in FIG. 2. The time it takes for the propulsion device 10 to be trimmed up from the position of FIG. 2 to that of FIG. 3 varies depending on the type and configuration of the tilt-trim actuator 28 and how and where the tilt-trim actuator 28 is coupled to the propulsion device 10.

Referring back to FIG. 1, the propulsion device 10 may be rotatable to an angle A1, where it is at angle from vertical V that provides a functional depth of the propeller 20 in the water 34 for propelling the marine vessel 30. In other words, the position of the propulsion device 10 were its centerline CL to be aligned with the line MT would be the same as that shown in FIG. 3, i.e. A1=PT. The propulsion device 10 may alternatively be trimmed to an angle A1+A2, where its centerline CL is at an angle from vertical V that raises the propeller 20 out of the water 34 altogether. Such a position is in the propulsion device's tilt range, which includes angles of the propulsion device 10 from vertical V that may be required for towing the marine vessel 30, for transporting the marine vessel 30 by land, or for utilizing a trolling motor to propel the marine vessel 30 instead. The line MT thus represents a demarcation between a trim range and a tilt range of the propulsion device 10. The maximum trim position may be achieved when the centerline of the propulsion device 10 is aligned along this line MT. Note that the full angle A1+A2 shown here is the maximum tilt position of the propulsion device 10, in which the trim rod 32*b* is fully extended from the trim cylinder 32*a*. This represents 100% of the potential full angular movement of the propulsion device 10.

Note that in some examples, the tilt-trim actuator 28 could in fact comprise separate cylinder/rod assemblies for rotating the propulsion device 10 through each of the tilt and trim regions. In other words, a first actuator (or pair of actuators) could rotate the propulsion device 10 through the angle A1 to the maximum trim position shown in FIG. 3, while a second actuator (or pair of actuators) could rotate the propulsion device 10 through the angle A2 to the maximum tilt position shown in FIG. 1. The separate tilt-trim actuators could be controlled by the same control module 42.

Figure 4:
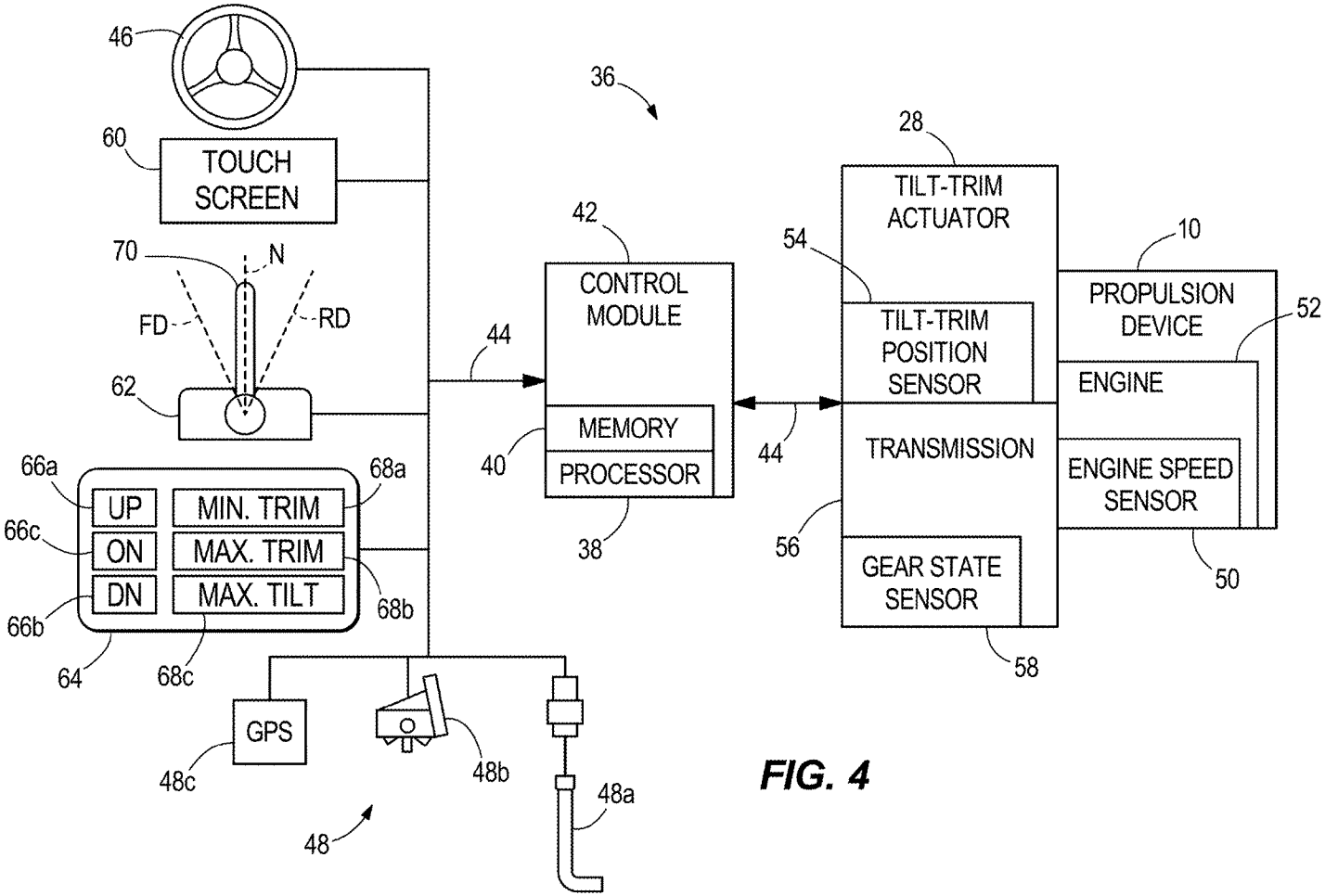
FIG. 4 illustrates a propulsion system according to the present disclosure.

FIG. 4 shows an example of a propulsion system 36 associated the marine vessel 30 of FIGS. 1-3, which carries out the methods described further herein below. In one example, software, which when executed by a processor 38 carries out the methods of the present disclosure, can be loaded in a memory 40 of a control module 42, such as an engine control module, a trim control module, a helm control module, etc. However, it should be understood that a separate control module could be provided for carrying out the methods described herein or that the methods described herein could be carried out by any combination of the above-described control modules or other types of control modules.

As used herein, the term "control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A control module may include memory (shared, dedicated, or group) that stores code executed by the processing system. The term "code" may include software, firmware, and/or microcode, and may refer to programs, routines, functions, classes, and/or objects. The term "shared" means that some or all code from multiple control modules may be executed using a single (shared) processor. In addition, some or all code from multiple control modules may be stored by a single (shared) memory. The term "group" means that some or all code from a single control module may be executed using a group of processors. In addition, some or all code from a single control module may be stored using a group of memories.

The control module 42 communicates with one or more components of the propulsion system 36 via input/output interfaces and a communication link 44, which can be a wired or wireless link. The control module 42 is capable of monitoring and controlling one or more operational characteristics of the propulsion system 36 and its various subsystems by sending and receiving control signals via the communication link 44. In one example, the communication link 44 is a controller area network (CAN) bus, but other types of links could be used. It should be noted that the extent of connections of the communication link 44 shown herein is for schematic purposes only, and the communication link 44 in fact provides communication between the control module 42 and each of the peripheral devices noted herein, although not every connection is shown in the drawing for purposes of clarity.

The control module 42 receives inputs from several different sensors and/or input devices aboard the marine vessel 30. For example, the control module 42 receives a steering input from a steering wheel 46 and/or joystick (not shown). The control module 42 is also provided with an input from a vessel speed sensor 48. The vessel speed sensor 48 may be, for example, a pitot tube sensor 48*a*, paddle wheel type sensor 48*b*, or any other speed sensor appropriate for sensing the actual speed of the marine vessel 30 in miles per hour (mph) or kilometers per hour (kph). The vessel speed may instead be obtained by taking readings from a GPS device 48*c*, which calculates speed by determining how far the marine vessel 30 has traveled in a given amount of time. The propulsion device 10 is provided with an engine speed sensor 50 such as a tachometer, which determines a speed of an engine 52 powering the propulsion device 10 in rotations per minute (RPM). This reading could be used, along with other data, to determine a pseudo vessel speed. A tilt-trim position sensor 54 is also provided for sensing an actual position of the tilt-trim actuator 28, for example, an amount of extension of the trim rod 32*b* with respect to the trim cylinder 32*a*, which corresponds to the trim position of the propulsion device 10. The tilt-trim position sensor 54 may be any type of sensor known to those having ordinary skill in the art, such as a Hall Effect sensor or a potentiometer. A transmission 56 and a gear state sensor 58 are also provided on the propulsion device 10.

Other inputs can come from operator input devices such as a touchscreen 60, a throttle lever 62, and a keypad 64. The touchscreen 60 or the keypad 64 can be used to initiate or exit any number of control or operation modes or to make selections while operating within one of the selected modes. The touchscreen 60 can display operational characteristics to the operator of the marine vessel 30 and can allow the operator to access propulsion system modes such as auto-heading, waypoint tracking, autopilot, and/or electronic anchoring. In one example, on the keypad 64, button 66*a* can be used to manually trim up the propulsion device 10, button 66*b* can be used to manually trim down the propulsion device, and button 66*c* can start, resume, or exit an auto-trim mode. The keypad 64 also includes a minimum trim position button 68*a*, a maximum trim position button 68*b*, and a maximum tilt position button 68*c*, the purpose of which will be described herein below. Note that these buttons 66*a-c* and 68*a-c* could be provided as selectable screen icons on the touchscreen 60 instead of or in addition to being provided on the keypad 64.

The throttle lever 62 allows the operator of the marine vessel 30 to choose to operate the marine vessel 30 in neutral, forward, or reverse, as is known, by actuating the handle 70 of the throttle lever 62 to different rotational positions. For example, the handle 70 can be rotated with respect to the base of the throttle lever 62 from a neutral detent position (see dashed line N) to a forward detent position (see dashed line FD), in which the engine 52 of the propulsion device 10 is in gear, but idling. Thereafter, the handle 70 can be advanced further in the forward direction to cause the engine 52 and the propeller 20 to rotate in forward gear and thereby provide forward thrust to the marine vessel 30. As the handle 70 is moved even more in the forward direction, the engine's throttle valve is increasingly opened and the propulsion device 10 provides increasing forward thrust to the marine vessel 30. If the handle 70 is retracted from neutral detent N to reverse detent (see dashed line RD), the propulsion device is put in reverse gear, but idling. As the handle 70 is moved even more in the reverse direction, the throttle valve is increasingly opened and the propulsion device 10 provides increasing reverse thrust to the marine vessel 30.

Now turning to FIG. 5, an example of logic that the control module 42 may use to carry out a method according to the present disclosure will be described. The logic begins at box 500, when an operator of the marine vessel 30 turns a key at the vessel's helm or presses a button at the helm to "key-on" the engine. As understood to those having ordinary skill in the art, this provides electrical power to the marine vessel 30, but does not start the engine 52. In order to start the engine 52, the key must be turned to the start position, or a separate "start" button must be selected. As shown at box 502, the method next includes determining whether a minimum trim position has been requested. For example, referring briefly to FIG. 4, the minimum trim position may be requested by way of selection of the minimum trim position button 68*a* on the keypad 64. If the minimum trim position has been requested, the method continues to box 504, where the control module 42 determines if the engine 52 is running. For example, the control module 42 may determine whether the key has been turned to the start position, may obtain a reading from the engine speed sensor 50, or may determine from reviewing previous control actions whether the engine 52 has been started. If the determination at box 504 is NO, i.e. the engine 52 is not running, the method continues to box 506, and the control module 42 controls the tilt-trim actuator 28 to trim the propulsion device 10 down. In this instance, a trim-down command is logical, because if the minimum trim position has been requested, the propulsion device 10 is most likely at a current trim position that is above the minimum trim position. If the propulsion device 10 is already at the minimum trim position, the control module 42 will exit the logic, although such decision is not shown herein.

The tilt-trim actuator 28 thereafter trims down the propulsion device 10, such as for example by removing hydraulic fluid from the trim cylinder 32*a* at the cylinder end and/or by providing hydraulic fluid to the trim cylinder 32*a* at the rod end. This is done as long as a signal from the control module 42 maintains a trim-down relay in an active state. While the tilt-trim actuator 28 is trimming down the propulsion device 10, the tilt-trim position sensor 54 measures the tilt-trim position, such as for example as a value between 0% (minimum trim position) and 100% (maximum tilt position). The control module 42 receives the measured, current tilt-trim position from the tilt-trim position sensor 54, and compares the current tilt-trim position to a trim position threshold, which is saved in the memory 40. As shown at box 508, if the current tilt-trim position is less than or equal to the trim position threshold, the method continues to box 510, where the control module 42 starts the engine 52. (Recall that it was determined that the engine 52 was not yet running at box 504). On the other hand, if the current tilt-trim position is not less than or equal to the trim position threshold, the method returns to box 506 and the tilt-trim actuator 28 continues to trim down the propulsion device 10. Returning to box 510, after the engine 52 is started, the tilt-trim actuator 28 continues to trim down the propulsion device 10 until the control module 42 determines, based on the reading from the tilt-trim position sensor 54, that the current tilt-trim position of the propulsion device 10 is equal to the desired tilt-trim position (here, the minimum trim position, as determined at box 504), as shown at box 512.

Returning to box 504, if the control module 42 determines that the engine 52 is running, the control module 42 next determines whether the engine speed, as measured by the engine speed sensor 50, is less than or equal to a predetermined engine idle speed, as shown at box 514. In one example, the engine idle speed is about 600 RPM, although other engine idle speeds could apply depending on the engine. If the engine speed is less than or equal to the engine idle speed, the method continues to box 512 and the control module 42 controls the tilt-trim actuator 28 to trim the propulsion device 10 down until it reaches the desired minimum trim position. Returning to box 514, if the engine speed is greater than the engine idle speed, the method continues to box 516, and returns to the key-on/ready state at box 500.

The method shown in boxes 502-512 or in boxes 502-516 is useful for allowing an operator to quickly transition from an engine-off or idling state, in which the marine vessel 30 is stopped and the propulsion device 10 may not even be in the trim range (see angle A1, FIG. 1), to trimming the propeller 20 into the water 34 and getting underway. Currently, an operator must manually hold the trim-down button 66*b* until the propulsion device 10 is at the minimum trim position before the operator can start the engine 52 and take off. The method described herein above allows an operator to quickly move the propulsion device 10 to the minimum trim (full tuck) position by the press of a single button, here shown as the minimum trim position button 68*a*. Requiring that the engine 52 be off (i.e., not running, see box 504) or on and idling (see box 514) before it can be trimmed down and started ensures that the engine 52 is not running above idle speed when the propulsion device 10 is not yet at a useable position in the water 34. For example, the logic at box 508 ensures that the current tilt-trim position of the propulsion device 10 is less than or equal to the trim position threshold before the engine 52 is started. In one example, the trim position threshold is greater than the minimum trim position, and may be equal to the maximum trim position (see FIG. 3). In another example, the trim position threshold is between the maximum trim position and the minimum trim position. In yet another example, the engine 52 is not started until the propulsion device 10 has reached the minimum trim position, i.e., the trim position threshold is equal to the minimum trim position.

If the minimum trim position is not requested as determined at box 502, the method continues to box 518, where the control module 42 determines if the maximum trim position has been requested. For example, the maximum trim position can be requested by selection of the maximum trim position button 68*b* on the keypad 64. The method proceeds to box 520, where the control module 42 determines if the current tilt-trim position as determined by the tilt-trim position sensor 54 is greater than the maximum trim position, which is predetermined and stored in the memory 40. If NO, the method continues to box 522 and it is determined if the engine 52 is running. If the answer at box 522 is YES, the method continues to box 524, where the control module 42 determines if a current vessel speed, as determined by the vessel speed sensor 48, is less than or equal to a vessel speed threshold. In one example, the vessel speed threshold is 15 mph, although other vessel speed thresholds could be programmed into the memory 40. Requiring that the marine vessel 30 is moving at a relatively slow speed before the propulsion device 10 can trim up to the maximum trim position will prevent unintended raising of the bow of the marine vessel 30. If the determination at box 524 is no, the method continues to box 526, where the control module 42 determines if the engine speed is less than or equal to an engine speed threshold. The logic of box 526 allows the propulsion device 10 to be trimmed to the maximum trim position while the marine vessel 30 is underway, but also ensures that loads on the propeller 20 will not be excessive by confirming that the engine speed is relatively low before allowing the propulsion device 10 to trim up. In one example, the engine speed threshold is 2,500 RPM, but the engine speed threshold could be different depending on the gear ratio of the transmission 56 and characteristics of the propeller 20.

If the answer at box 526 is NO, the method continues to box 528, where the control module 42 determines if the throttle lever 62 is in at least one of a forward detent, neutral, and reverse detent position. If no, the method continues to box 530, and returns to key-on/ready. If YES at box 528, the method continues to box 532 and the control module 42 sends a signal to the tilt-trim actuator 28 to trim the propulsion device 10 up to the maximum trim position. The determination at box 528 allows the propulsion device 10 to be trimmed up to the maximum trim position even if the vessel speed is not less than or equal to the vessel speed threshold (box 524) and the engine speed is not less than or equal to the engine speed threshold (box 526), because the throttle lever 62 is in a position that indicates both the vessel speed and engine speed will likely quickly decrease. In another example, the control module 42 uses a reading from the gear state sensor 58 to determine if the engine 52 is in forward detent, neutral, or reverse detent.

Returning to box 522, if the control module 42 determines that the engine 52 is not running, i.e., is stopped, the method continues directly to box 532, and the tilt-trim actuator 28 is controlled to trim the propulsion device 10 up to the maximum trim position. Similarly, if the determination at either of boxes 524 or 526 is YES, the method continues directly to box 532, and the marine propulsion device 10 is trimmed up to the maximum trim position. These vessel speed and/or engine speed conditions being met indicate that trimming the propulsion device 10 up to the maximum trim position will not have detrimental effects on the vessel's attitude or produce harmful loads on the propeller 20. Note that in other examples, multiple ones of the determinations at boxes 524, 526, and 528 may need to be true before the marine propulsion device 10 will be trimmed up to the maximum trim position. Thus, the determinations shown herein are not the only way to implement the present method.

Returning to box 520, if the control module 42 determines that the current tilt-trim position is greater than the maximum trim position, the method continues to box 534. Note that if the current tilt-trim position is equal to the maximum trim position, the operator's request has effectively already been fulfilled, and the method will return to the key-on/ready state. (Note also that the determination at boxes 522 and 534 could be done before the determination at box 520 and/or simultaneously with the determination at box 520.) If the determination at box 534 is YES, the method continues to box 536, where the control module 42 determines if the engine speed as determined by the engine speed sensor 50 is less than or equal to a predetermined engine idle speed. As noted hereinabove, the engine idle speed could be 600 RPM, although other engine idle speeds could be saved in the memory 40. If YES at box 536, the method continues to box 538, and the control module 42 controls the tilt-trim actuator 28 to trim the propulsion device 10 down to the maximum trim position. If the determination at box 536 is NO, the method continues to box 530, and returns to the key-on/ready state. Note that it is unlikely that the determination at box 536 would be NO, seeing as having an engine 52 running above idle speed while the propeller 20 is not in the water would be very loud and would annoy the operator.

Returning to box 534, if the control module 42 determines that the engine 52 is not running, the method continues to box 540, and the control module 42 activates a trim-down relay that causes the trim rod 32*b* to be retracted into the trim cylinder 32*a*. Meanwhile, the tilt-trim position sensor 54 measures the current tilt-trim position of the propulsion device 10. Once the current tilt-trim position is less than or equal to a predetermined trim position threshold saved in the memory 40, as shown at box 542, the method continues to box 544, where the control module 42 starts the engine 52. The method thereafter continues to box 538, and the tilt-trim actuator 28 continues to trim the propulsion device 10 down to the maximum trim position. The determination at box 542 ensures that the engine 52 is not started until the predetermined trim position threshold is reached, which may, for example, be the maximum trim position, slightly greater than the maximum trim position, or the first trim position threshold used at box 508, such that the engine 52 can be started immediately before or after the propeller 20 enters the water. The exemplary threshold could be calibrated to ensure that the engine 52 is not started well above the maximum trim position, where it would create annoying noise.

Returning to box 518, if the maximum trim position is not requested, the method continues to box 546, where it is determined if the maximum tilt position is requested. For example, the maximum tilt position can be requested by way of selection of the maximum tilt position button 68*c* on the keypad 64. Note that if none of the minimum trim position is requested (box 502), the maximum trim position is requested (box 518), nor the maximum tilt position is requested (box 546), the method returns to box 500. Note also that the logic of the boxes 502, 518, and 546 need not be undertaken in the order shown, or could be undertaken simultaneously. Returning to box 546, if the maximum tilt position is requested, the method continues to box 548, where the control module 42 determines if the engine 52 is running. If the engine 52 is running, the method continues to box 550, and control module 42 determines if the vessel speed is less than or equal to a vessel speed threshold. As mentioned hereinabove, the vessel speed threshold could be 15 mph, but other vessel speed thresholds could be used. If the answer at box 550 is YES, the method continues to box 552, where the control module 42 determines if the engine speed is less than or equal to an engine idle speed. If the answer is NO at either of boxes 550 or 552, the method continues to box 554, where it returns to the key-on/ready state. On the other hand, if the answer at box 552 is YES, the control module 42 activates a trim-up relay to cause the trim rod 32*b* to extend further from the trim cylinder 32*a*, as shown at box 554. The checks at boxes 550 and 552 have ensured that the marine vessel 30 is moving relatively slowly and that the engine 52 is either already stopped or idling, and the propulsion device 10 can therefore be brought up out of the water to the maximum tilt position.

While the propulsion device 10 is being trimmed up, the control module 42 will determine if the current tilt-trim position is greater than or equal to a predetermined trim position threshold, as shown at box 556. If the answer is YES, the method continues to box 558, and the control module 42 stops the engine 52. In one example, the trim position threshold is the maximum trim position, above which the engine 52 would make unpleasantly loud noise if it were running while the propeller 20 was out of the water. In another example, the threshold is between the maximum trim position and the maximum tilt position. In another example, the threshold is the maximum tilt position, and the engine 52 is not stopped until the propulsion device 10 reaches that desired position. Note that if the current tilt-trim position is not greater than or equal to the trim position threshold, as determined at box 556, the method returns to box 554 and the propulsion device 10 is trimmed up until the condition at box 556 is satisfied. After box 558, the method includes trimming up to the maximum tilt position 560, except in the case that the threshold is the maximum tilt position.

Note also that if the determination at box 548 is NO, i.e., the engine 52 is not running, the propulsion device 10 may immediately be trimmed up to the maximum tilt position, because the engine 52 of the propulsion device 10 will not be running while it is out of the water. This is the usual condition in which an operator will trim up the propulsion device 10 to the maximum tilt position, only in this instance, he can do so without having to hold down a trim-up or tilt-up button the entire time.

Figure 6:
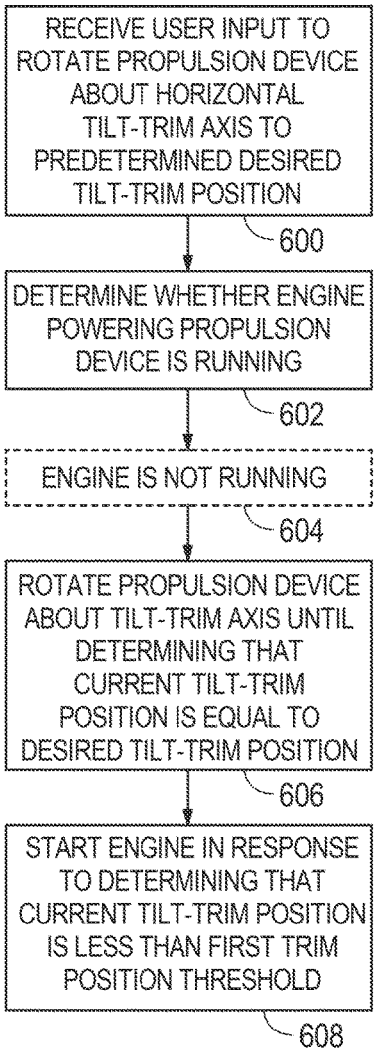
FIG. 6 illustrates one method according to the present disclosure.

Now turning to FIG. 6, a method for controlling a tilt-trim position of a marine propulsion device 10 on a transom 22 of a marine vessel 30 will be described. The method is carried out by a control module 42 and includes, as shown at box 600, receiving a user input to rotate the propulsion device 10 about a horizontal tilt-trim axis 26 to a predetermined desired tilt-trim position. The predetermined desired tilt-trim position may be a minimum trim position, a maximum trim position, or a maximum tilt position, as described hereinabove with respect to FIGS. 2, 3, and 1 respectively. The method continues at box 602, and includes determining whether an engine 52 powering the propulsion device 10 is running. In response to determining that the engine is not running, as shown at 604, the method includes rotating the propulsion device 10 about the tilt-trim axis 26 until determining that a current tilt-trim position of the propulsion device 10 is equal to the desired tilt-trim position, as shown at box 606. As shown at box 608, the method also includes starting the engine 52 in response to determining that the current tilt-trim position is less than a first trim position threshold. In one example, the first trim position threshold is different from the desired tilt-trim position. For example, as described hereinabove with respect to boxes 508 and 542, the first trim position threshold can be greater than the desired tilt-trim position.

According to some examples of the method, in response to determining that the engine 52 is running, the method further comprises determining whether at least one of a vessel speed condition and an engine speed condition is met. For example, see boxes 504 and 514, boxes 522, 524 and 526, boxes 534 and 536, and boxes 548, 550, 552. In response to the at least one of the vessel speed condition and the engine speed condition being met, the control module 42 rotates the propulsion device 10 about the tilt-trim axis 26 until the determining that the current tilt-trim position is equal to the desired tilt-trim position. See, for example, box 512, box 532, box 538, and box 560.

In response to determining that the engine 52 is running and that the at least one of the vessel speed condition and the engine speed condition is met, the method may further include stopping the engine 52 in response to determining that the current tilt-trim position is greater than or equal to a second trim position threshold. For example, see boxes 556 and 558.

In one example, the method includes determining if the engine speed condition is met and determining a speed of the engine 52, such as by way of the engine speed sensor 50. In one example, the engine speed condition is that the engine speed is less than or equal to an engine speed threshold. For example, see boxes 514, 526, and 552. In some examples, the engine speed threshold is a predetermined engine idle speed. See boxes 514 and 552.

In one example of the present disclosure, the user input may be a command to rotate the propulsion device 10 to a predefined trim position, such as a predefined maximum trim position. In such an example, the method may further include comparing the current tilt-trim position, as determined by the tilt-trim position sensor 54, to the maximum trim position in response to receiving the user input. With reference to boxes 520, 540, 542, 544, and 538, in response to determining that the current tilt-trim position is greater than the maximum trim position and that the engine 52 is not running, the method includes rotating the propulsion device 10 down until determining that the current tilt-trim position is equal to the maximum trim position. With reference to boxes 520, 522, and 532, in response to determining that the current tilt-trim position is less than the maximum trim position and that the engine 52 is not running, the method may include rotating the propulsion device 10 up until determining that the current tilt-trim position is equal to the maximum trim position.

Figure 7:
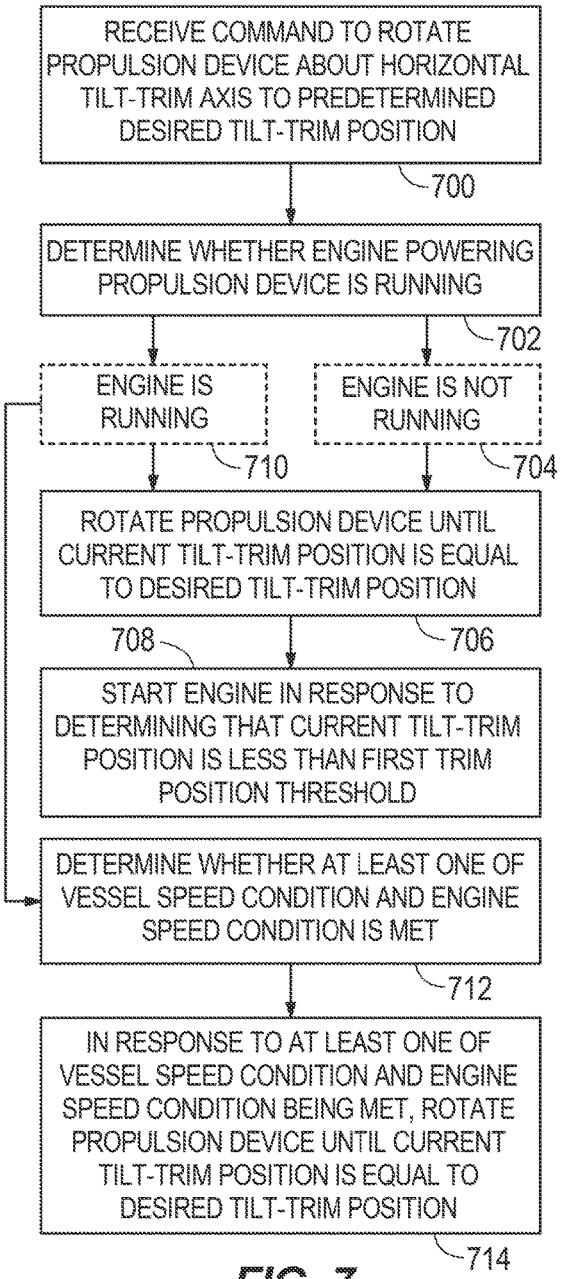
FIG. 7 illustrates another method according to the present disclosure.

Turning to FIG. 7, another method for controlling a tilt-trim position of a marine propulsion device 10 on a transom 22 of a marine vessel 30 will be described. This method is carried out by a system that includes a user input device (keypad 64 or touchscreen 60) that generates a command to rotate the propulsion device 10 to a predetermined desired tilt-trim position. An engine speed sensor 50 senses a speed of an engine 52 powering the propulsion device 10. A vessel speed sensor 48 senses a speed of the marine vessel 30. A tilt-trim position sensor 54 senses a current tilt-trim position of the propulsion device 10 with respect to the transom 22. A control module 42 receives the command from the user input device 64, 60, the engine speed from the engine speed sensor 50, the vessel speed from the vessel speed sensor 48, and the tilt-trim position from the tilt-trim position sensor 54. A tilt-trim actuator 28 is configured to rotate the propulsion device 10 about a horizontal tilt-trim axis 26 in response to signals from the control module 42.

As shown in FIG. 7, the system carries out a method that includes receiving a command to rotate the propulsion device 10 about the horizontal tilt-trim axis 26 to the predetermined tilt-trim position, as shown at 700. The method next includes determining if the engine 52 powering the propulsion device 10 is running, as shown at 702. In response to determining that the engine 52 is not running, as shown at 704, the control module 42 controls the tilt-trim actuator 28 to rotate the propulsion device 10 about the tilt-trim axis 26 until determining that the current tilt-trim position is equal to the desired tilt-trim position, as shown at 706. The control module also starts the engine 52 in response to determining that the current tilt-trim position is less than or equal to a first trim position threshold, as shown at 708. If the control module 42 determines that the engine 52 is running, as shown at 710, the control module 42 also determines whether at least one of a vessel speed condition and an engine speed condition is met, as shown at 712. In response to the at least one of the vessel speed condition and the engine speed condition being met, the control module 42 controls the tilt-trim actuator 28 to rotate the propulsion device 10 about the tilt-trim axis 26 until determining that the current tilt-trim position is equal to the desired tilt-trim position, as shown at 714.

Referring back to FIG. 4, the user input device, such as the keypad 64 or touchscreen 60, may include a button 68*a* configured to allow an operator of the marine vessel 30 to select a minimum trim position of the propulsion device 10 as the desired tilt-trim position. In response to selection of the minimum trim position button 68*a* (box 502) and determining that the engine 52 is not running (box 504: NO), the control module 42 controls the tilt-trim actuator 28 to rotate the propulsion device 10 down to the minimum trim position (box 512). In such an example, the first trim position threshold may be greater than the minimum trim position. In response to selection of the minimum trim position button 68*a* (box 502), determining that the engine 52 is running (box 504: YES), and determining that the engine speed is less than a predetermined engine idle speed (box 514), the control module 42 controls the tilt-trim actuator 28 to rotate the propulsion device 10 down to the minimum trim position (box 512).

In another example, the user input device comprises a button 68*b* configured to allow an operator the marine vessel 30 to select a maximum trim of the propulsion device 10 as the desired tilt-trim position. The control module 42 compares the current tilt-trim position to the maximum trim position (box 520). In response to selection of the maximum trim position button 68*b* (box 518), determining that the current tilt-trim position is less than the maximum trim position (box 520: NO), and determining that the engine 52 is not running (box 522: NO), the control module 42 controls the tilt-trim actuator 28 to rotate the propulsion device 10 up to the maximum trim position (box 532). The system may further include a throttle lever 62 that provides a vessel speed command to the control module 42. In response to selection of the maximum trim position button 68*b* (box 518), determining that the current tilt-trim position is less than the maximum trim position (box 520: NO), and determining that the engine 52 is running (box 522: YES), the control module 42 controls the tilt-trim actuator 28 to rotate the propulsion device 10 up to the maximum trim position only if at least one of the following conditions is also true: the vessel speed is less than or equal to a predetermined vessel speed threshold (box 524); the engine speed is less than or equal to a predetermined engine speed threshold (box 526); and a handle 70 of the throttle lever 62 is in a forward detent FD, neutral N, or reverse detent RD position (box 528).

In response to selection of the maximum trim position button 68*b* (box 518), determining that the current tilt-trim position is greater than the maximum trim position (box 520: YES), and determining that the engine 52 is not running (box 534: NO), the control module 42 controls the tilt-trim actuator 28 to rotate the propulsion device 10 down to the maximum trim position (box 538). In response to selection of the maximum trim position button 68*b* (box 518), determining that the current tilt-trim position is greater than the maximum trim position (box 520: YES), and determining that the engine 52 is running (box 534: YES), the control module 42 controls the tilt-trim actuator 28 to rotate the propulsion device 10 down to the maximum trim position only if the engine speed is less than or equal a predetermined engine idle speed (box 536).

In yet another example, the user input device comprises a button 68*c* configured to allow an operator of the marine vessel 30 to select a maximum tilt position of the propulsion device 10 as the desired tilt-trim position. In response to selection of the maximum tilt position button 68*c* (box 546) and determining that the engine 52 is not running (box 548: NO), the control module 42 controls the tilt-trim actuator 28 to rotate the propulsion device 10 up to the maximum tilt position (box 560). In response to selection of the maximum tilt position button 68*c* (box 546) and determining that the engine 52 is running (box 548: YES), the control module 42 controls the tilt-trim actuator 28 to rotate the propulsion device 10 up to the maximum tilt position only if at least one of the following conditions is also true: the vessel speed is less than or equal to a predetermined vessel speed threshold (box 550), or the engine speed is less than or equal to a predetermined engine idle speed (box 552). In some examples, both box 550 and box 552 must be true before the propulsion device 10 will be trimmed up. Eventually, the control module 42 stops the engine 52 (box 558) in response to determining that the current tilt-trim position is greater than or equal to a second trim position threshold (box 556). The second trim position threshold may be less than the maximum tilt position, or may be equal to the maximum tilt position.

In each of the above described examples of the method, the user input is received in response to selection of a single button by an operator of the marine vessel 30 after the engine 52 has been keyed on, as shown at box 500. The minimum trim position button 68*a*, maximum trim position button 68*b*, and maximum tilt position button 68*c* on the keypad 64 therefore provide a simple, one-step way for the operator to both trim the propulsion device 10 to a desired position and at the same start or stop the engine 52, depending on the desired tilt-trim position.

Figure 8:
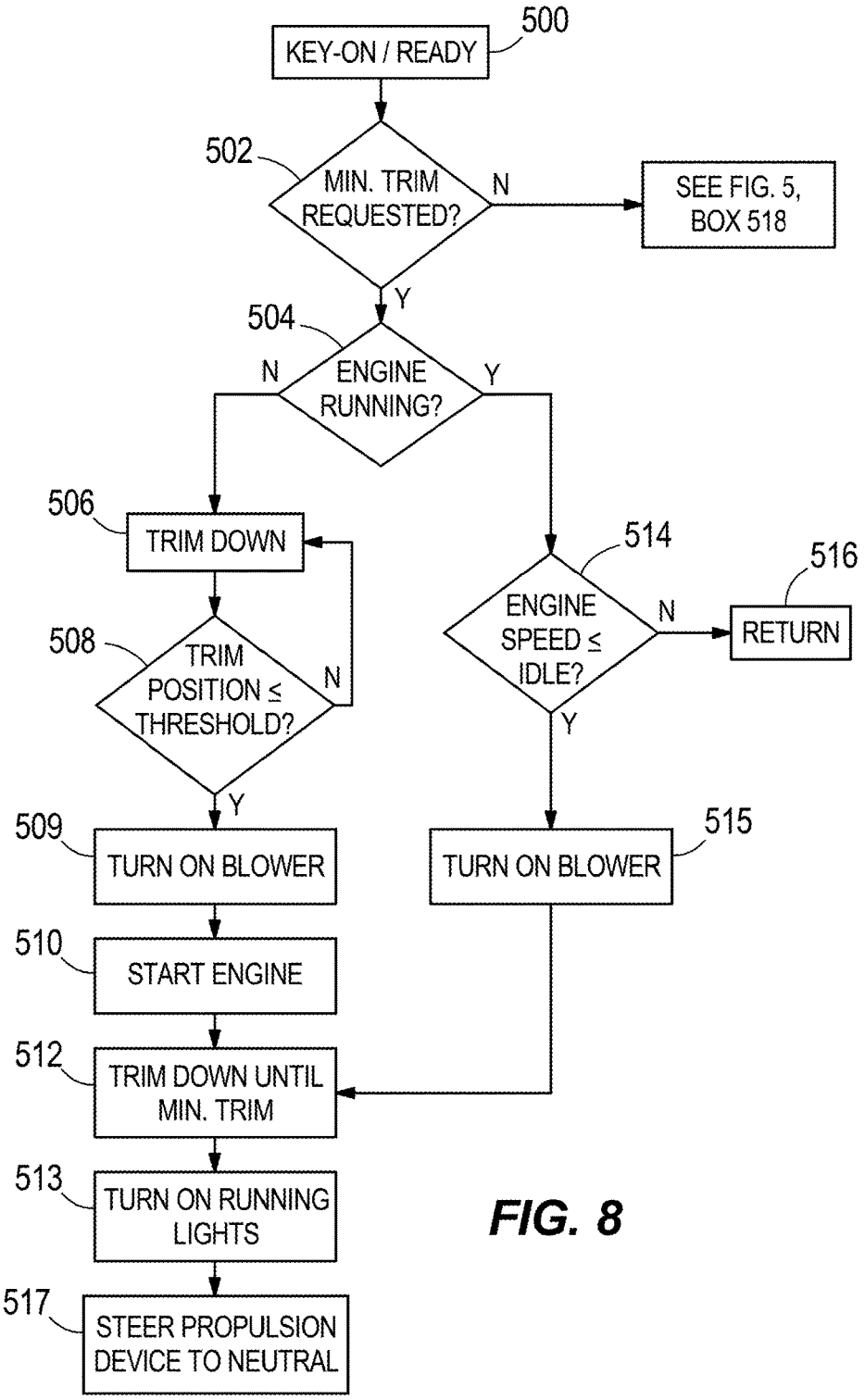
FIG. 8 illustrates an alternative to a portion of the method of FIG. 5.
Figure 9:
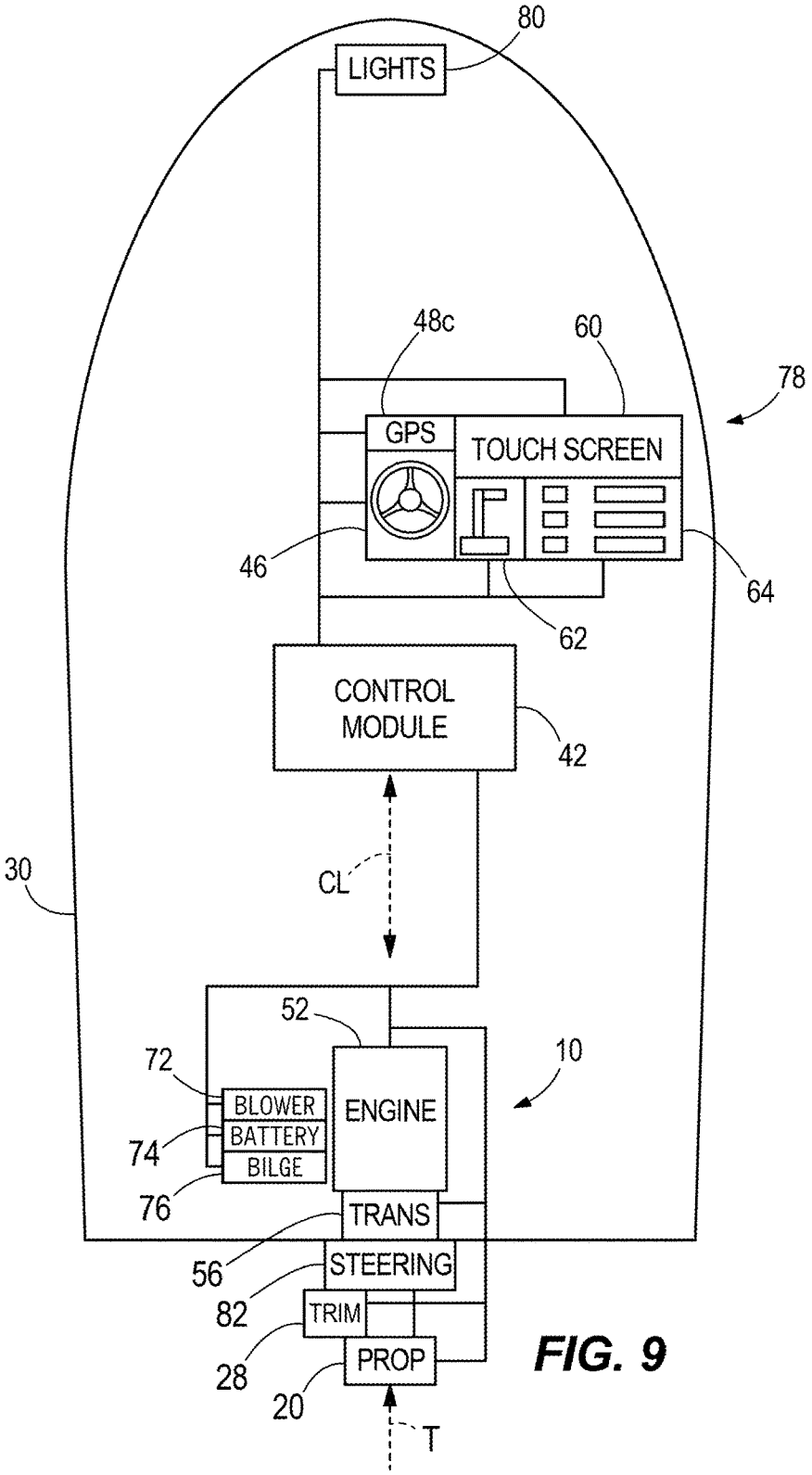
FIG. 9 illustrates an embodiment of a marine vessel according to the present disclosure.

Referring to FIGS. 8 and 9, further exemplary systems and methods according to the present disclosure will be described. FIG. 9 shows the vessel 30 with several additional and alternative components. The control module 42 is connected in signal communication with a blower 72, a battery 74 powering the blower 72, and a bilge monitor 76 which can sense various conditions in the bilge of the marine vessel 30, such as water level or the accumulation of fumes. A blower is generally provided with a sterndrive, in which the engine 52 is located inboard and the steerable propeller 20 is located outboard, as shown in FIG. 9. As is known, the blower 72 can be turned on manually by way of a switch located at the helm 78 of the vessel 30 in order to exchange the air within the bilge with fresh outside air. This prevents buildup of fumes in the bilge when the engine 52 is running at slow speeds. The vessel 30 also includes running lights 80, which are also in communication with the control module 42. Generally, the running lights 80 can be illuminated by flipping a switch at the helm 78. Note that although running lights 80 are shown only at the bow of the vessel 30, they could be provided at the stern and/or on the propulsion device 10 as well. A steering actuator 82, such as a hydraulic or electric actuator, is also in signal communication with the control module 42, and generally is activated in response to signals from the steering wheel 46, a joystick, an autopilot module, or another steering command input at the helm 78. In the example shown, the propulsion device 10 is in a neutral steering position, in which the steering actuator 82 has steered the propeller 20 about its steering axis such that the propeller 20 produces thrust T that is aligned generally parallel to a centerline CL of the vessel 30.

Figure 5:
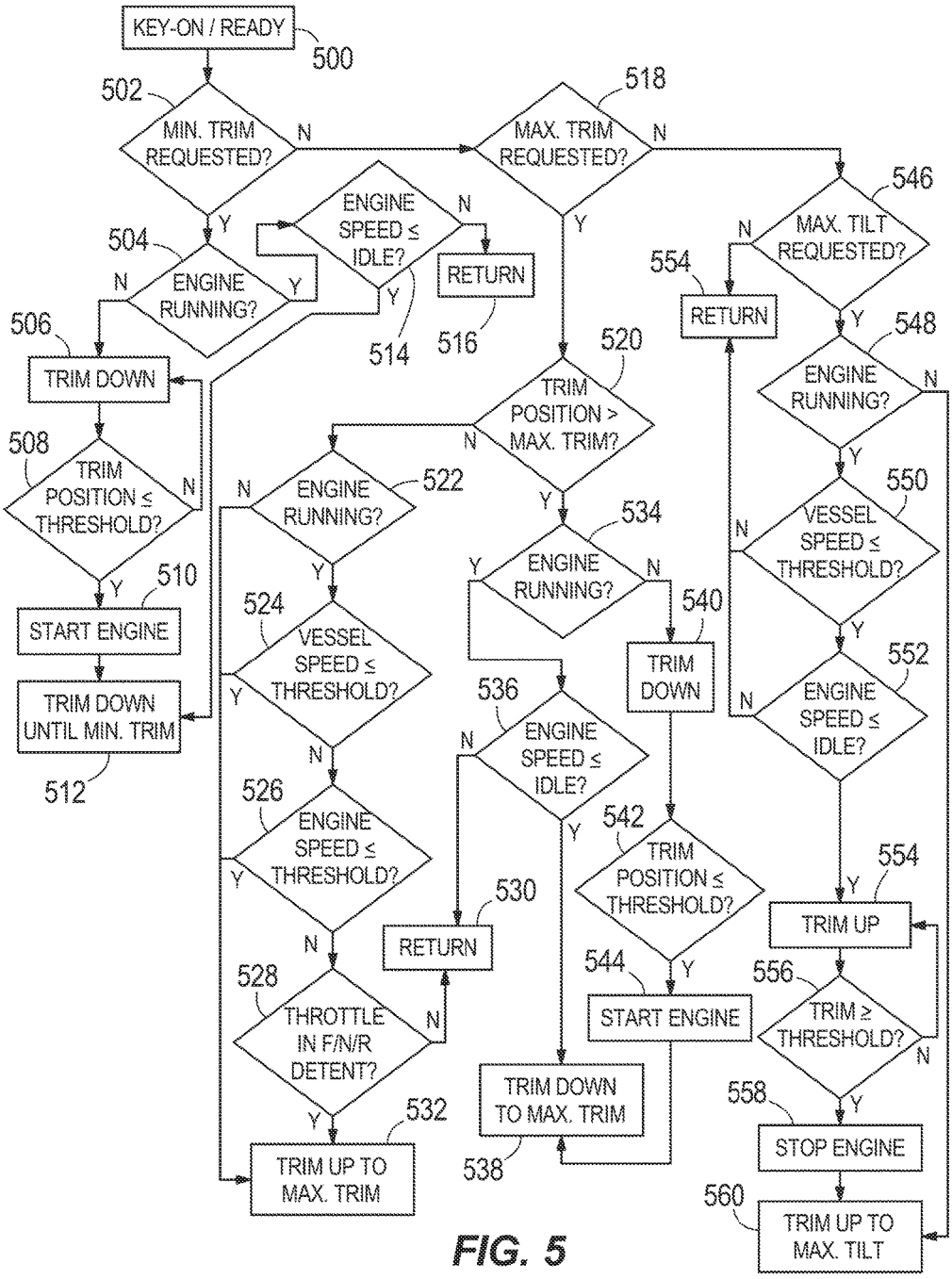
FIG. 5 illustrates one example of logic that a control module can use to determine how to position the propulsion device and whether to start or stop an engine powering the propulsion device.

The method of FIG. 8 begins at box 500, which is the same as box 500 of FIG. 5. The method proceeds as described herein above with respect to FIG. 5, with the following optional additional steps. For example, in response to selection of the minimum trim position button 68*a* on the keypad 64 or touch screen 60, the control module 42 does at least one of the following: turns on the blower 72 in the bilge of the marine vessel 30; turns on running lights 80 on the marine vessel 30; and/or rotates a steerable portion of the propulsion device 10 to a neutral steering position. In the event that the propulsion device 10 is an outboard motor or similar, the steerable portion is the entire drive unit. In the event that the propulsion device 10 is a sterndrive or similar, the steerable portion is the outboard portion, including the propeller 20.

Assuming the method proceeds through boxes 504 and 506, after it is determined at box 508 that the current tilt-trim position is less than or equal to the trim position threshold, the method proceeds to box 509, and the control module 42 sends a signal to turn the blower 72 on. The control module 42 may then wait a predetermined period of time before starting the engine 52, as shown at box 510. In alternative examples, box 509 is omitted (such as if the propulsion device 10 is an outboard motor); box 510 immediately follows box 509 without any delay; boxes 509 and 510 are executed simultaneously; or box 510 is executed prior to box 509. Likewise, the control module 42 may turn on the blower 72 after box 514, in the event that the determinations at boxes 504 and 514 are true. Alternatively, the control module 42 may turn on the blower 72 before the control module 42 makes the determination at box 514. In either case, whether the method proceeds through boxes 506, 508, 509, and 510 or through boxes 514 and 515, the method continues with controlling the tilt-trim actuator 28 to trim the propulsion device 10 down until it reaches the desired minimum trim position, as shown at box 512. By automatically turning on the blower 72 in response to the minimum trim position having been requested and prior to starting the engine 52 (or in response to the minimum trim position having been requested and determining that the engine 52 is already running), the control module 42 saves the operator another step of having to turn on the blower 72 manually before getting underway.

The method may additionally or alternatively include turning on the running lights 80 on the vessel 30 and/or propulsion device 10, as shown at box 513. The control module 42 may turn the running lights 80 on after box 512, or at any time after the minimum trim position is requested at box 502. The method may additionally or alternatively include steering the propulsion device 10 to the neutral steering position, as shown at box 517. The control module 42 can do this before or while trimming the propulsion device 10 down, or after the propulsion device 10 has achieved the desired minimum trim position. Note that boxes 513 and 517 could be performed simultaneously or in reverse of the order shown herein. By programming the control module 42 to turn on the running lights 80 and/or steer the propulsion device 10 to the neutral steering position in response to selection of the minimum trim position button 68*a*, the operator again has fewer things to perform manually before getting underway.

The present system and corresponding methods may be especially useful to operators who engage in tournament or recreational fishing, when they are required to pack up their gear quickly, launch the vessel, and get to the next fishing hole as efficiently as possible. The present system and methods eliminate the need for the operator to manually hold a trim button until the propulsion device 10 is at the desired trim position and then to start the engine 52 before taking off, instead requiring him only to push the minimum trim position button 68*a*. The present system and method can also be used to aid in the process of coasting or motoring into a known shallow spot, where trim needs to be adjusted to the maximum trim position to avoid hitting the bottom of the body of water with the propulsion device 10. Simplifying this with the simple push of a maximum trim position button 68*b* is beneficial. Providing the full trailer/maximum tilt position option could be used when transferring from a primary propulsion device 10 to a kicker or trolling motor, when motoring into locations that are too shallow even for the maximum trim position, or after loading the vessel 30 onto a trailer. The operator needs to simply push the maximum tilt position button 68*c*, and the propulsion device 10 will automatically move to the requested position. The above algorithm/logic controls such trimming to the requested positions in order to prevent an inadvertent trim operation when underway, especially when the marine vessel 30 is operating at higher speeds.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims. Each limitation in the appended claims is intended to invoke interpretation under 35 U.S.C. § 112(f), only if the terms "means for" or "step for" are explicitly recited in the respective limitation.

What is claimed is:

1. A method for controlling a tilt-trim position of a marine propulsion device on a transom of a marine vessel, the method being carried out by a control module and comprising:

receiving a user input to rotate the propulsion device about a horizontal tilt-trim axis to a predetermined desired tilt-trim position;

determining whether an engine powering the propulsion device is running; and in response to determining that the engine is not running:

rotating the propulsion device about the tilt-trim axis until determining that a current tilt-trim position of the propulsion device is equal to the desired tilt-trim position; and starting the engine in response to determining that the current tilt-trim position is less than a first trim position threshold.

2. The method of claim 1, wherein in response to determining that the engine is running, the method further comprises determining whether at least one of a vessel speed condition and an engine speed condition is met; and in response to the at least one of the vessel speed condition and the engine speed condition being met, rotating the propulsion device about the tilt-trim axis until determining that the current tilt-trim position is equal to the desired tilt-trim position.

3. The method of claim 2, wherein in response to determining that the engine is running and that the at least one of the vessel speed condition and the engine speed condition is met, the method further comprises stopping the engine in response to determining that the current tilt-trim position is greater than or equal to a second trim position threshold.

4. The method of claim 2, wherein the method includes determining if the engine speed condition is met and further comprises determining a speed of the engine;

wherein the engine speed condition is that the engine speed is less than or equal to an engine speed threshold.

5. The method of claim 1, wherein the first trim position threshold is different from the desired tilt-trim position.

6. The method of claim 1, wherein the user input is a command to rotate the propulsion device to a predefined maximum trim position.

7. The method of claim 6, further comprising comparing the current tilt-trim position to the maximum trim position in response to receiving the user input;

wherein, in response to determining that the current tilt-trim position is greater than the maximum trim position and that the engine is not running, the method includes rotating the propulsion device down until determining that the current tilt-trim position is equal to the maximum trim position; and wherein, in response to determining that the current tilt-trim position is less than the maximum trim position and that the engine is not running, the method includes rotating the propulsion device up until determining that the current tilt-trim position is equal to the maximum trim position.

8. The method of claim 1, wherein the user input is received in response to selection of a single button by an operator of the marine vessel after the engine has been keyed-on.

9. The method of claim 1, wherein the user input is a command to rotate the propulsion device to a predefined minimum trim position, and wherein the method further comprises doing at least one of the following in response to receiving the user input:

turning on a blower in a bilge of the marine vessel;

turning on running lights on the marine vessel; and rotating a steerable portion of the propulsion device to a neutral steering position.

10. A system for controlling a tilt-trim position of a marine propulsion device on a transom of a marine vessel, the system including:

a user input device generating a command to rotate the propulsion device to a predetermined desired tilt-trim position;

an engine speed sensor sensing a speed of an engine powering the propulsion device;

a vessel speed sensor sensing a speed of the marine vessel;

a tilt-trim position sensor sensing a current tilt-trim position of the propulsion device with respect to the transom;

a control module receiving the command from the user input device, the engine speed from the engine speed sensor, the vessel speed from the vessel speed sensor, and the current tilt-trim position from the tilt-trim position sensor; and a tilt-trim actuator configured to rotate the propulsion device about a horizontal tilt-trim axis in response to signals from the control module;

wherein the control module determines whether the engine is running and then does one of the following:

in response to determining that the engine is not running:

controls the tilt-trim actuator to rotate the propulsion device about the tilt-trim axis until determining that the current tilt-trim position is equal to the desired tilt-trim position; and starts the engine in response to determining that the current tilt-trim position is less than or equal to a first trim position threshold; or in response to determining that the engine is running:

determines whether at least one of a vessel speed condition and an engine speed condition is met; and in response to the at least one of the vessel speed condition and the engine speed condition being met, controls the tilt-trim actuator to rotate the propulsion device about the tilt-trim axis until determining that the current tilt-trim position is equal to the desired tilt-trim position.

11. The system of claim 10, wherein the user input device comprises a button configured to allow an operator of the marine vessel to select a minimum trim position of the propulsion device as the desired tilt-trim position; and wherein in response to selection of the minimum trim position button and determining that that engine is not running, the control module controls the tilt-trim actuator to rotate the propulsion device down to the minimum trim position.

12. The system of claim 11, wherein the first trim position threshold is greater than the minimum trim position.

13. The system of claim 11, wherein in response to selection of the minimum trim position button, determining that the engine is running, and determining that the engine speed is less than a predetermined engine idle speed, the control module controls the tilt-trim actuator to rotate the propulsion device down to the minimum trim position.

14. The system of claim 11, wherein in response to selection of the minimum trim position button, the control module does at least one of the following:

turns on a blower in a bilge of the marine vessel;

turns on running lights on the marine vessel; and rotates a steerable portion of the propulsion device to a neutral steering position.

15. The system of claim 10, wherein the user input device comprises a button configured to allow an operator of the marine vessel to select a maximum trim position of the propulsion device as the desired tilt-trim position;

wherein the control module compares the current tilt-trim position to the maximum trim position; and wherein in response to selection of the maximum trim position button, determining that the current tilt-trim position is less than the maximum trim position, and determining that the engine is not running, the control module controls the tilt-trim actuator to rotate the propulsion device up to the maximum trim position.

16. The system of claim 15, further comprising a throttle lever that provides a vessel speed command to the control module;

wherein in response to selection of the maximum trim position button, determining that the current tilt-trim position is less than the maximum trim position, and determining that the engine is running, the control module controls the tilt-trim actuator to rotate the propulsion device up to the maximum trim position only if at least one of the following conditions is also true:

the vessel speed is less than or equal to a predetermined vessel speed threshold;

the engine speed is less than or equal to a predetermined engine speed threshold; and a handle of the throttle lever is in a forward detent, neutral, or reverse detent position.

17. The system of claim 15, wherein in response to selection of the maximum trim position button, determining that the current tilt-trim position is greater than the maximum trim position, and determining that the engine is not running, the control module controls the tilt-trim actuator to rotate the propulsion device down to the maximum trim position.

18. The system of claim 17, wherein in response to selection of the maximum trim position button, determining that the current tilt-trim position is greater than the maximum trim position, and determining that the engine is running, the control module controls the tilt-trim actuator to rotate the propulsion device down to the maximum trim position only if the engine speed is less than or equal to a predetermined engine idle speed.

19. The system of claim 10, wherein the user input device comprises a button configured to allow an operator of the marine vessel to select a maximum tilt position of the propulsion device as the desired tilt-trim position; and wherein in response to selection of the maximum tilt position button and determining that the engine is not running, the control module controls the tilt-trim actuator to rotate the propulsion device up to the maximum tilt position.

20. The system of claim 19, wherein in response to selection of the maximum tilt position button and determining that the engine is running, the control module controls the tilt-trim actuator to rotate the propulsion device up to the maximum tilt position only if at least one of the following conditions is also true:

the vessel speed is less than or equal to a predetermined vessel speed threshold; and the engine speed is less than or equal to a predetermined engine idle speed; and wherein the control module stops the engine in response to determining that the current tilt-trim position is greater than or equal to a second trim position threshold.

21. The system of claim 20, wherein the second trim position threshold is less than the maximum tilt position.

22. The method of claim 4, wherein the engine speed threshold is a predetermined engine idle speed.

* * * * *